United States Patent [19]

Inada et al.

[11] 4,367,674

[45] Jan. 11, 1983

[54] ACTUATOR DEVICE

[75] Inventors: Masami Inada; Kongou Aoki, both of Kariya, Japan

[73] Assignee: Aisin Seiki Kabushiki Kaisha, Kariya, Japan

[21] Appl. No.: 123,516

[22] Filed: Feb. 22, 1980

[30] Foreign Application Priority Data

Feb. 23, 1979 [JP] Japan ..... 54-23425[U]

[51] Int. Cl.[3] ..... F01B 19/00

[52] U.S. Cl. ..... 92/13.2; 92/13.8; 92/26; 411/6

[58] Field of Search ..... 92/13.2, 13.6, 13.8, 92/26; 411/1, 6, 7

[56] References Cited

U.S. PATENT DOCUMENTS

| | | | |
|---|---|---|---|
| 3,168,011 | 2/1965 | Baumann | 92/13.8 |
| 3,229,592 | 1/1966 | Puster | 92/13.2 |
| 3,529,908 | 9/1970 | Smith | 92/13.2 |
| 3,547,088 | 12/1970 | Yagi | 123/97 R |
| 3,555,491 | 1/1971 | Moss | 411/7 |
| 3,843,169 | 10/1974 | Wise | 411/1 |
| 3,905,279 | 9/1975 | Yadon | 92/13.8 |
| 3,945,302 | 3/1976 | Downs | 92/13.2 |
| 3,969,988 | 7/1976 | Maurer | 92/26 |
| 4,024,800 | 5/1977 | Masclet | 92/26 |
| 4,033,232 | 7/1977 | Benjamin | 92/13.6 |
| 4,060,063 | 11/1977 | Hirasawa | 123/97 B |
| 4,092,213 | 5/1978 | Nishimura | 92/17 |
| 4,137,876 | 2/1979 | Volpe | 123/103 R |
| 4,198,844 | 4/1980 | Lowe | 92/13.8 |

*Primary Examiner*—Abraham Hershkovitz

*Attorney, Agent, or Firm*—Oblon, Fisher, Spivak, McClelland & Maier

[57] ABSTRACT

An actuator device used with an engine-idle control system of an automobile provided with an air-conditioner, and is adapted so as to operate an operating rod in association with a throttle valve opening lever of an internal combustion engine. The actuator device includes an actuator housing having a guide member, a diaphragm member within the housing to thereby define two chambers within the housing, a plunger member secured to the diaphragm member at one end thereof and extending out through the housing at the other end thereof, the plunger member being slidably supported by the guide member, a lock nut for fastening the operating rod to the plunger member and being of hexagonal external form, an adjusting member including a hub portion in which a nut member is securely positioned, the nut member being moved via threads formed on the plunger member, a plurality of extending members which axially extend from the hub portion and which are elastically in contact with the hexagonal external face of the lock nut, the hub portion having a ring shaped knurling peripheral portion, and a stopping flange portion in contact with the guide member.

4 Claims, 3 Drawing Figures

ACTUATOR DEVICE

BACKGROUND OF THE INVENTION

1. Field of the Invention

The present invention relates to an actuator device for use with an engine-idle control system of and automobile provided with an air-conditioner and, more particularly, to a vacuum controlled throttle positioning actuator having an improved mechanism for adjusting the stroke of operating plunger in association with throttle valve opening lever of an internal combustion engine.

2. Description of the Prior Art

In an automobile equipped with an air-conditioner compressor driven by internal combustion engine, it has been proposed that, under idling conditions of the engine, the opening degree of the throttle valve is slightly increased to provide the engine with a larger amount of air-fuel mixture when the air-conditioner compressor starts to run. It has been required to increase the engine power to prevent stalling of the engine under such loaded idling condition. A throttle valve operating mechanism of this general type includes a vacuum controlled throttle positioning actuator as found in U.S. Pat. No. 4,060,063 granted Nov. 29, 1977. Such conventional actuator does not include a mechanism for adjusting the stroke of operating plunger to maintain a predetermined increased opening degree of the throttle valve, so that it is difficult to reliably maintain a desirable opening degree of the throttle valve. On the other hand, actuators having an adjusting mechanism threaded through rear case portion of the actuator are shown, for example, in U.S. Pat. No. 4,137,876 granted on Feb. 6, 1979 and U.S. Pat. No. 3,547,088 granted on Dec. 15, 1970. Such conventional actuators are equipped with an adjustable stop for limiting stroke of the diaphragm. The adjustable stop is threaded through the housing of the vacuum chamber positioned behind the operating plunger, so that such stop is not applied to the actuator having a vacuum control such as solenoid valve provided in the vacuum chamber.

In a conventional actuator having an adjustable stop connected to the plunger, it has been proposed to use a double nut, however, it is difficult to adjustably move the double nut since such requires the use of two wrenches.

SUMMARY OF THE INVENTION

It is, therefore, a principal object of the present invention to provide an improved actuator device which obviates the above noted conventional disadvantages.

It is another object of the present invention to provide an improved actuator device wherein adjustment of the stroke of the plunger can be reliably achieved by easy manual operation without the use of a tool.

It is a further object of the present invention to provide an improved actuator device which is simple in construction, low in cost, and reliably adjustable.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
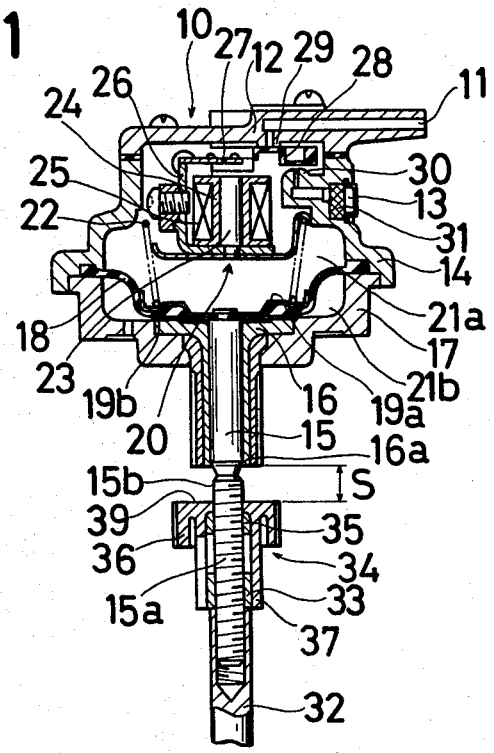
FIG. 1 is a vertical cross sectional view showing an actuator device embodying the inventive concept of the present invention.

Referring now to FIG. 1, there is shown the structure of the actuator device in accordance with the present invention. The actuator device 10 includes a first body 12 having a first port 11, a second body 14 having a second port 13 and a third body 17 having a guide member 16 for slidably supporting a plunger member 15 therein. A diaphragm member 18 is fixedly hermetically secured between second and third bodies 14 and 17 at the outer peripheral portion thereof. An adjusting member 34 is provided on a small diameter portion **15*a* of plunger member 15**.

Plunger member 15 is connected at an upper end thereof to the inner peripheral portion of diaphragm member 18 having a pair of plates **19*a*, 19*b* mounted thereon, and is slidably guided by guide member 16. Therefore, plunger member 15 is axially movable together with diaphragm member 18. A lower portion of small diameter portion 15*a* of plunger member 15 is connected to an operating rod 32** in association with a throttle valve opening lever of an internal combustion engine (not shown).

Within the first, second and third bodies chambers **21*a* and 21*b* are defined by the arrangement of diaphragm member 18. Incorporated within chamber 21*a* is an electromagnetic valve 20 which includes a bobbin 24 on which a solenoid coil 25 is wound, an iron core 23 on which a yoke member 26 is secured, a movable leaf member 27 rotatably movably located on the knife edge of yoke member 26 at one end thereof by means of spring, and a valve member 28 provided on the other end of leaf member 27. Valve member 28 is normally in contact with a seat 29 provided on first body 12 and is normally spaced from a seat 30 provided on the second body 14 by the spring force. Solenoid coil 25** is adapted to receive electric signals from a computer of an engine idling control system in response to vehicle engine operating conditions.

Operating chamber **21*a* is selectively alternatively in communication with first port 11 or second port 13 continuously by means of the operation of valve member 28. Second port 13 receives atmospheric pressure by means of air filter member 31 while first port 11** is, for example, connected with a negative pressure source such as an intake manifold of the internal combustion engine.

A spring 22 provided within chamber **21*a* normally biases diaphragm member 18 downwardly as viewed in FIG. 1. Operating rod 32 is securely fastened to threaded portion 15*b* of plunger member 15 by means of a lock nut 33 which is of hexagonal external form. Accordingly, rod 32 and plunger member 15** move unitarily.

Figure 2:
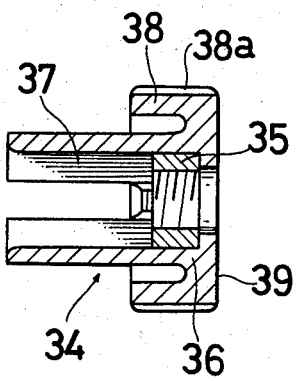
FIG. 2 is the enlarged vertical cross sectional view of an adjusting member shown in FIG. 1; and, FIG. 3 is a left side view of FIG. 2.
Figure 3:
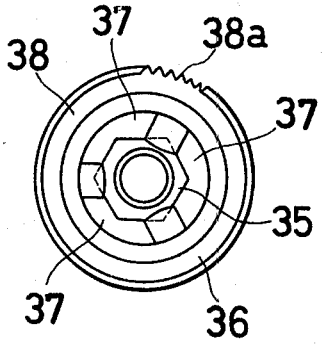

Adjusting member 34 has a hub portion 36 with a stopping flange portion 39, a plurality of extending members 37 which axially extend from the hub portion 36 and a ring shaped portion 38 having a knurled periphery **38*a* on hub portion 36. A hexagonal nut 35 is inserted within hub portion 36 and is threadedly moved on small diameter portion 15***a*. Nut 35 is securely caulked between extending members 37 as shown in FIG. 2 and FIG. 3.

Extending members 37 are elastically radially deformed upon contact with the hexagonal external face of lock nut 33 at at least one section thereof to radially grip lock nut 33. As a result, such gripping prevents the threaded movement of the nut 35, so that a predetermined stroke length of plunger member 15 as shown by S in FIG. 1 is maintained.

When adjusting member 34 is on rotated plunger member 15 through knurled periphery 38*a* with a predetermined force, nut 35 is threaded axially moved on small diameter portion 15*a*. Consequently, the stroke of plunger member 15 may be easily varied and adjusted without the use of a tool.

In operation, when solenoid coil 25 is energized in response to, for example, operation of the engine-idle control system of an automobile provided with an air-conditioner, leaf member 27 is moved downwardly in FIG. 1 from its illustrated and initial position. Valve member 28 is then separated from seat 29 and is brought in to contact with seat 30.

Accordingly, chamber 21*a*, which has been in communication with atmospheric pressure through port 13, is now in communication with the negative pressure source through port 11. Due to the pressure differential between chambers 21*a* and 21*b*, diaphragm member 18, plunger member 15, and plates 19*a*, 19*b* move upwardly against the biasing force of spring 22. Operating rod 32 interconnected between the plunger member 15 and throttle valve opening lever will simultaneously move upwardly so as to change the opening degree of the throttle valve. As a result, flange portion 39 is brought in to contact with end portion 16*a* of plunger member 15, so that the opening degree of the throttle valve is maintained at a predetermind value according to the stroke of plunger member 15 as shown by reference letter S in FIG. 1.

When solenoid coil 25 is de-energized, leaf member 27 is returned to its initial position. Valve member 28 is returned to its original position as shown is FIG. 1, and as a result, chamber 21*a*, which has been in communication with the negative pressure source through port 11, is in communication with atmospheric pressure through port 13, so that spring 22 again biases diaphragm member 18 downwardly so as to return all of the members to their original positions.

Various modifications and alterations of this invention will be obvious to those skilled in the art without departing from the scope and spirit of this invention, and it should be understood that this invention is not to be unduly limited to the illustrative embodiment set forth herein.

What is claimed is:

1. An actuator device for use with an engine-idle control system of an automobile provided with an air-conditioner, said actuator device comprising:

an actuator housing;

a guide member disposed within said housing;

diaphragm means positioned within said housing to thereby define two chambers within said housing;

a plunger member secured to said diaphragm means and extending out from said housing, said plunger member being slidably supported by said guide member and having a threaded portion formed thereon; and adjusting means mounted on said plunger member and threadedly connected to said threaded portion formed on said plunger member for adjusting the stroke of said plunger member wherein said adjusting means further comprises;

a hub portion;

a nut member engaging said threaded portion of said plunger member and which is positioned within said hub portion;

an operating rod engaging said plunger member;

a lock nut interconnecting said rod and said plunger member and which includes a hexagonal external face; and a plurality of extending members which axially extend from said hub portion, wherein said hub portion further comprises a ring shaped peripheral portion having a knurled periphery, said plurality of said extending members elastically contacting said hexagonal external face of said lock nut and said hub portion including a stopping flange portion which contacts said guide member upon shifting of said adjusting means.

2. An actuator device for use with an engine-idle control system of an automobile provided with an air conditioner, said actuator device comprising:

an actuator housing;

a guide member disposed within said housing and having a lower end portion;

diaphragm means positioned within said housing to define first and second chambers within said housing;

a plunger member for effecting an operating stroke, said plunger member being secured to said diaphragm means and extending out from said housing, said plunger member being slidably supported by said guide member and having a threaded portion formed thereon;

an operating rod engaging said plunger member;

a lock nut interconnecting said rod and said plunger member, said lock nut including a hexagonal external face;

adjusting means mounted on said plunger member and being threadedy connected to said threaded portion formed on said plunger member for adjusting said operating stroke of said plunger member, wherein said adjusting means further comprises;

a hub portion having an upper surface portion defining a flat flange portion for abutting said lower end portion of said guide member so as to limit said operating stroke of said plunger member;

a nut member positioned within said hub portion for engaging said threaded portion of said plunger member;

a plurality of extending members axially extending from said hub portion for gripping said external hexagonal face of said lock nut;

a ring shaped peripheral portion having a knurled priphery formed on said hub portion for rotating said adjusting means for adjusting said operating stroke of said plunger member; and said plurality of extending members further comprising radially elastically deformable extending members and each of said plurality of extending members having at least one internal axial channel formed therein for contacting said external hexagonal face of said lock nut such that rotation of said adjusting means under a predetermined force effects radial deformation of said plurality of extending members.

3. An actuator device according to claim 2 wherein said plurality of radially elastically deformable extending members define an axial channel having an axial cross section smaller than an axial cross section of said lock nut such that engagement of said plurality of radially elastically deformable extending members with said external hexagonal face of said lock nut radially deforms said radially elastically deformable extending members to provide a gripping force therebetween.

4. An actuator device according to claim 3 wherein each of said plurality of radially elastically deformable extending members further comprises a lower end portion having a chamfer formed thereon for facilitating engagement with said lock nut.

* * * * *

UNITED STATES PATENT AND TRADEMARK OFFICE

CERTIFICATE OF CORRECTION

PATENT NO. : 4,367,674

DATED : January 11, 1983

INVENTOR(S) : MASAMI INADA ET AL

It is certified that error appears in the above-identified patent and that said Letters Patent is hereby corrected as shown below:

In column 1, line 7, delete "and" before "automobile" and insert therefor --an--;

In column 2, line 7, delete "an" before "adjusting" and insert therefor --the--;

In column 2, line 33, delete "bodies" and insert therefor --body--;

In column 3, line 12, delete "on rotated" and insert therefor --rotated on--;

In column 3, line 14, delete "threaded axially" and insert therefor --threadedly--;

UNITED STATES PATENT AND TRADEMARK OFFICE

CERTIFICATE OF CORRECTION

PATENT NO. : 4,367,674

DATED : January 11, 1983

INVENTOR(S) : MASAMI INADA ET AL

It is certified that error appears in the above-identified patent and that said Letters Patent is hereby corrected as shown below:

In column 3, line 38, delete "predetermind" and insert therefor --predetermined--;

In column 3, line 43, delete "is" after "shown" and insert therefor --in--;

In column 4, line 44, delete "threadedy" and insert therefor --threadedly--;

In column 4, line 59, delete "priphery" and insert therefor --periphery--.

Signed and Sealed this

First Day of November 1983

[SEAL]

Attest:

GERALD J. MOSSINGHOFF

Attesting Officer

Commissioner of Patents and Trademarks